US012655739B2

(12) United States Patent
Robinson et al.

(10) Patent No.: US 12,655,739 B2
(45) Date of Patent: Jun. 16, 2026

(54) SAND CATCHER FOR DOWNHOLE PUMP AND METHOD FOR USING SAME

(71) Applicant: OIL TOOL SOLUTIONS, INC., Houston, TX (US)

(72) Inventors: Mark Robinson, Houston, TX (US); Andrew Jardine Leitch, Olivella (ES); John Laughlin, Waller, TX (US); Brent Patton, Magnolia, TX (US)

(73) Assignee: OIL TOOL SOLUTIONS, LLC, Houston, TX (US)

( * ) Notice: Subject to any disclaimer, the term of this patent is extended or adjusted under 35 U.S.C. 154(b) by 0 days.

(21) Appl. No.: 19/228,849

(22) Filed: Jun. 5, 2025

(65) Prior Publication Data

US 2025/0376919 A1 Dec. 11, 2025

Related U.S. Application Data

(60) Provisional application No. 63/656,606, filed on Jun. 6, 2024.

(51) Int. Cl.
*E21B 43/34* (2006.01)
*E21B 43/12* (2006.01)

(52) U.S. Cl.
CPC ..... *E21B 43/35* (2020.05); *E21B 43/128* (2013.01)

(58) Field of Classification Search
CPC ..... E21B 43/128; E21B 43/35
See application file for complete search history.

(56) References Cited

U.S. PATENT DOCUMENTS 541,699 A * 6/1895 Stevenson ..... E21B 27/00 166/99
1,114,721 A * 10/1914 Bell ..... E21B 43/38 417/543
1,601,921 A * 10/1926 Mccoy ..... E21B 43/35 166/105.1

(Continued)

FOREIGN PATENT DOCUMENTS

CN 211573789 U 9/2020
CN 115450891 A 12/2022
CN 117108521 A 11/2023

OTHER PUBLICATIONS

PCT International Search Report for PCT/US2025/032364 dated Aug. 21, 2025.

*Primary Examiner* — Shane Bomar
(74) *Attorney, Agent, or Firm* — Edmonds & Cmaidalka, P.C.

(57) ABSTRACT

Apparatus and methods for protecting a submersible pump. The apparatus can include a cage having at least two longitudinal support arms, at least one window defined between any two of the support arms, and a perforated insert is at least partially disposed within the cage, wherein a first end of the perforated insert has a seat formed therein for engaging a moveable member that is contained within the cage, wherein passage of solids, fluids or both through the flow path is at least partially restricted in a first flow direction when the moveable member contacts the seat of the perforated insert and passage through the flow path is not restricted in a second flow direction that is opposite of the first flow direction when the moveable member does not contact the seat.

15 Claims, 8 Drawing Sheets

(56) References Cited

U.S. PATENT DOCUMENTS

| | | | | |
|---|---|---|---|---|
| 2,701,533 | A * | 2/1955 | Abney | E21B 43/38 166/105.1 |
| 4,662,831 | A * | 5/1987 | Bennett | E21B 43/127 417/430 |
| 6,347,668 | B1 * | 2/2002 | McNeill | E21B 21/10 166/332.7 |
| 2002/0197174 | A1 * | 12/2002 | Howard | E21B 27/02 417/569 |
| 2014/0014358 | A1 * | 1/2014 | Leitch | E21B 43/08 166/105.4 |
| 2021/0156225 | A1 * | 5/2021 | Arterbury | F04D 29/708 |
| 2023/0340964 | A1 | 10/2023 | Leitch et al. | |
| 2024/0344432 | A1 * | 10/2024 | Snyder | E21B 43/35 |

* cited by examiner

SAND CATCHER FOR DOWNHOLE PUMP AND METHOD FOR USING SAME

TECHNICAL FIELD

Embodiments provided herein relate to sand protection devices for downhole pumps and methods for using same.

BACKGROUND

An oil well is a hole that has been dug into the Earth to bring oil or other hydrocarbons from a subsurface reservoir or formation to the surface. When the natural drive energy of the reservoir is not strong enough to push the hydrocarbons to the surface or gets depleted over time, artificial lift techniques are used to assist the recovery. Artificial lift is a process to increase pressure within the reservoir and encourage the hydrocarbons to the surface. Electrical submersible pumps ("ESPs") and progressive cavity pumps ("PCPs") are commonly used in hydrocarbon extraction, such as oil wells, or geothermal systems, such as water heating systems.

An ESP is typically used at the bottom of the production tubing and deep within the wellbore. An ESP typically has an electrical motor controlled by a power cable from the surface, a seal section which provides sealing and pressure protection for the motor, and a centrifugal pump having multiple impeller stages designed to increase pressure. ESPs can be highly efficient pumps capable of high production rates and can be particularly well suited for the production of lighter crudes and superheated water as in geothermal wells.

PCPs can be also located at the bottom of the production tubing. PCPs can be mechanical positive displacement pumps driven by a continuous shaft from the surface. The shaft can be typically engaged with a drive system at the surface and rods pass down the production tubing to a rotor, the rotor engages a stator unit, and both the rotor and the stator can be configured with helical shaped protrusions located within the pump housing. During operation the rotation of the rotor within the stator provides positive displacement, allowing production to surface. PCPs can be generally specified for higher crudes and lower production rates.

Particularly in oil wells, sand can also be produced in large quantities, typically measured in parts per million. Sand can be erosive when contacting other materials or surfaces. Particularly though, sand entrained in the column of fluid above the pump, may settle back on top of the pump when the system is shut down. Shutdowns can occur for a variety of reasons, such as sudden power outage at the surface, and for controlled procedures, such as shutdown for management and maintenance.

When sand settles back to the top of the pump, falling by virtue of gravity, the sand primarily fills the upper stages or sections of the pump, thereby creating additional frictional force preventing rotation of the shaft, and reducing the head of pressure that can be produced. In doing so, a column of sand above may be formed, creating a plug which further constrains the pump. Due to the depth of the pump in the well, and the amount of sand involved, a plug often means a full tubing joint of sand can settle on the pump, creating a significant barrier for the pump to overcome when restarting. In many cases the pump is not able to overcome the blockage and so eventually burns out due to lack of fluid. In such instances, the entire pump must be retrieved to surface, requiring the removal of the production tubing and associated equipment, in what is called a workover. A workover, whilst sometimes planned, can be a very expensive operation that may be further exacerbated because of lost production.

Conventional sand protection devices have been used that divert the sand to an annular chamber or divert the sand into the production zone below the ESP. However, diversion to an annular chamber still allows finer particles to reach the ESP and cannot be entirely flushed due to their geometrical design. Likewise, diversion of sand from the system by exiting the tubing string entirely, leaves the system subject to external conditions that may prevent sand removal and allow sand to enter or block the ESP.

There is still a need, therefore, for new tools and devices for handling sand in a wellbore or other subterranean environment equipped with a submersible pump.

SUMMARY

A downhole tool for protecting submersible pumps and methods for using same are provided. In at least one specific embodiment, the tool includes a cage having at least two longitudinal support arms, at least one window defined between any two of the support arms; and a perforated insert that is at least partially disposed within the cage, wherein a first end of the perforated insert has a seat formed therein for engaging a moveable member that is contained within the cage, wherein passage of solids, fluids or both across the perforated insert is at least partially restricted in a first flow direction when the moveable member contacts the seat of the perforated insert and not restricted in a second flow direction that is opposite of the first flow direction when the moveable member does not contact the seat.

In at least one other specific embodiment, the tool includes a cage having at least two longitudinal support arms, at least one window defined between any two of the support arms, and an annular spacer configured to support the at least two longitudinal support arms; and a perforated insert that is at least partially disposed within the cage, wherein a first end of the perforated insert has a seat formed therein for engaging a moveable member that is contained within the longitudinal support arms of the cage, wherein passage of solids, fluids or both across the perforated insert is at least partially restricted in a first flow direction when the moveable member contacts the seat of the perforated insert and not restricted in a second flow direction that is opposite of the first flow direction when the moveable member does not contact the seat.

In one or more embodiments, the method comprises providing a production tubular, a downhole pump in the production tubular, and a sand catcher sub-assembly (as described herein) coupled to the production tubular above the downhole pump; stopping the pump to cause fluid to flow in a second flow direction through the production tubular toward the pump, wherein passage of the fluid through the cage is at least partially restricted in the second flow direction when the moveable member contacts the seat of the perforated insert, and solid particles within the fluid are collected about the outside of the perforated insert; and restarting the pump to cause fluid to flow in the first flow direction through the production tubular away from the pump, which lifts at least a portion of the collected solid particles away from the sand catcher sub-assembly and carries away the lifted solid particles within the fluid.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
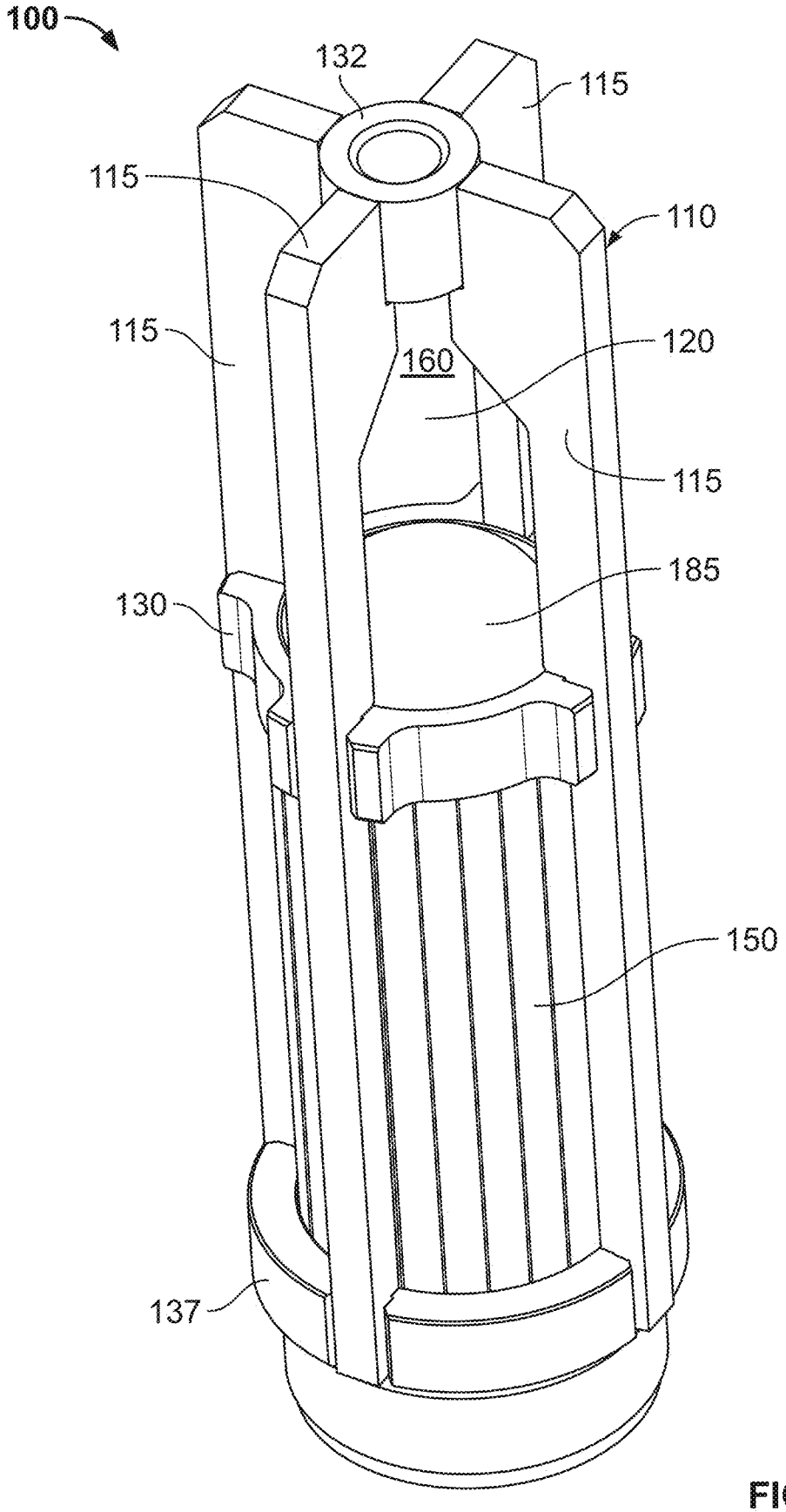
FIG. 1 depicts an illustrative schematic view a sand catcher sub-assembly 100, according to one or more embodiments described.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows may include embodiments in which the first and second features are formed in direct contact and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function.

The terms "including" and "comprising" are used in an open-ended fashion, and thus should be interpreted to mean "including, but not limited to."

The term "or" is intended to encompass both exclusive and inclusive cases, i.e., "A or B" is intended to be synonymous with "at least one of A and B," unless otherwise expressly specified herein.

The terms "up" and "down"; "upward" and "downward"; "upper" and "lower"; "upwardly" and "downwardly"; "above" and "below"; "first" and "second" and other like terms as used herein refer to relative positions to one another and are not intended to denote a particular spatial orientation since the apparatus and methods of using the same may be equally effective at various angles or orientations.

Figure 2:
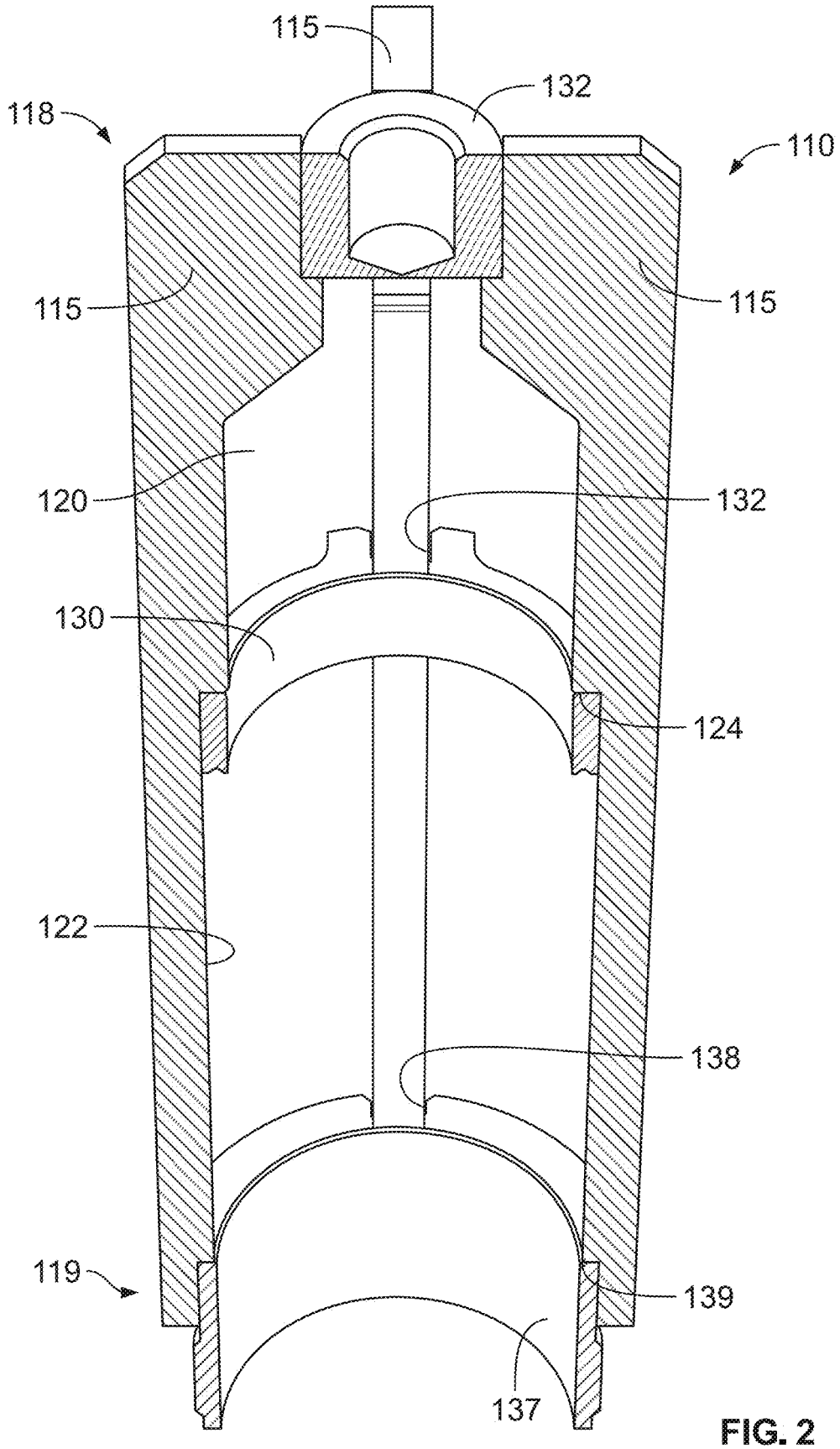
FIG. 2 depicts an illustrative partial vertical cross section of the sub-assembly 100, according to one or more embodiments described.

A more detailed description of the sand catcher sub-assembly and downhole pump protection tool will now be described with reference to the figures provided. With reference to the figures, FIG. 1 depicts an illustrative schematic view of a sand catcher sub-assembly or tool 100, according to one or more embodiments, and FIG. 2 depicts an illustrative partial vertical cross section of the sand catcher sub-assembly shown in FIG. 1. The sub-assembly housing 110 can include at least one body or cage 110 and at least one perforated insert 150 that is configured to at least partially fit within the cage 110. The body or cage 110 can be formed by at least two longitudinal support arms 115. The longitudinal support arms 115 are spaced-apart and define at least one void, window or opening 120 there between. Preferably, two, three, four or more support arms 115 are used (four are shown). Each opening or window 120 is simply a void or space between two adjacent support arms 115.

The perforated insert 150 can be at least partially contained within the support arms 115. The perforated insert 150 contains a plurality of openings that allow fluids to pass through as well as other particles that are less than a predetermined size, such as less than 2,000 nm, 1,000 nm, 500 nm, 400 nm, 100 nm, or 50 nm. The openings can be circular, square, rectangular, elliptical, as well as elongated slots, slits or the like. In certain embodiments, the perforated sleeve 150 can be a wire mesh screen.

As explained in more detail below, the perforated insert 150 serves as a filter or screen to impede or block solid materials in the fluid flowing across the sub-assembly 100, whereby passage of solids (e.g. clay particles, sand, etc.) into the internal diameter (ID) of the perforated insert 150 is substantially restricted or blocked in a first flow direction when the moveable device 185 contacts a seat 151 of the perforated insert 150. When the moveable device 185 contacts the seat 151 of the perforated insert 150, the perforated insert 150 also helps maintain fluid equilibrium with the sub-assembly 100 while filtering and/or screening solid particles or particulates from entering the annulus of the sleeve 150 and potentially continuing through to a submersible pump located below the sub-assembly 100.

Figure 3:
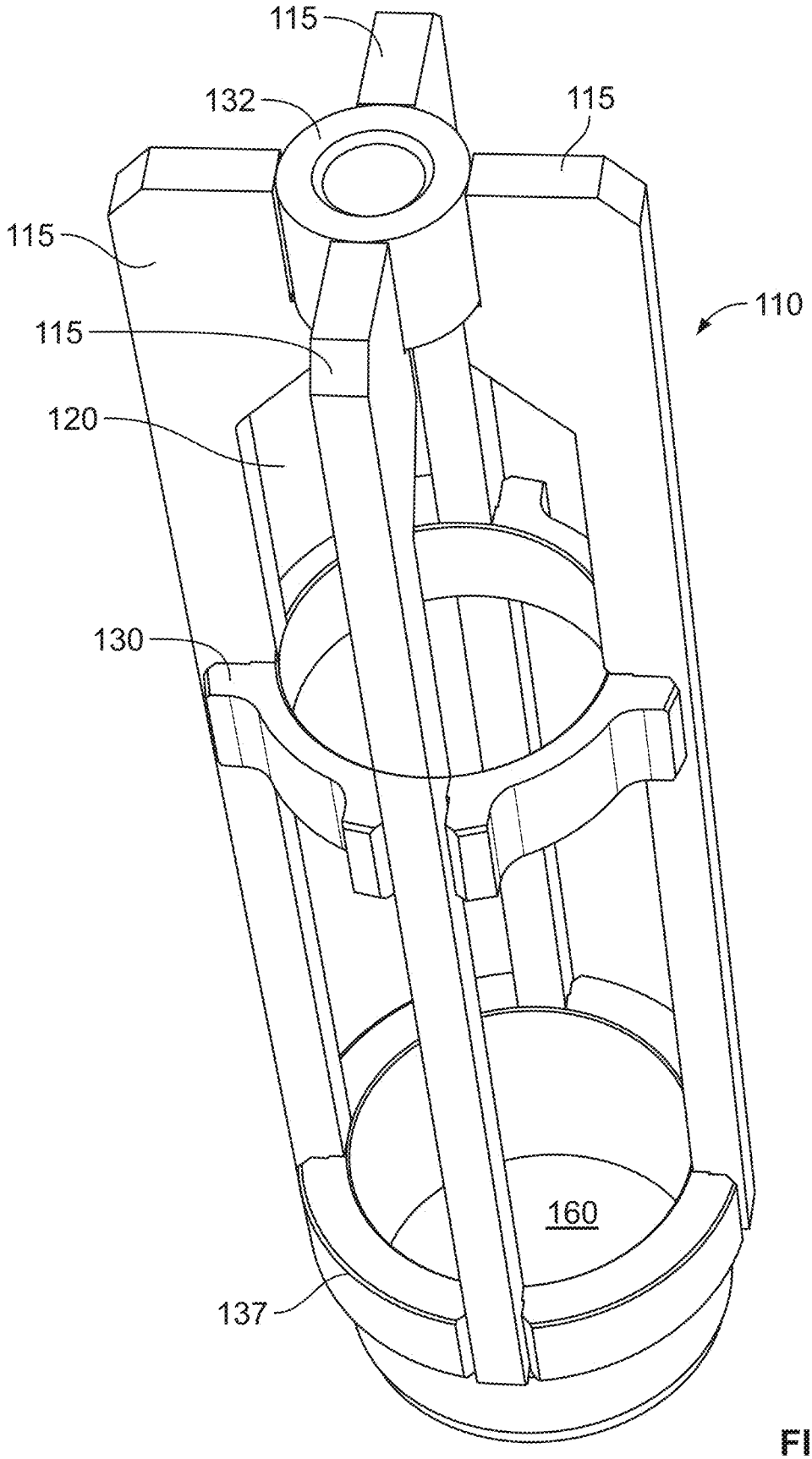
FIG. 3 depicts an illustrative top isometric view of the sub-assembly 100, according to one or more embodiments described.
Figure 4:
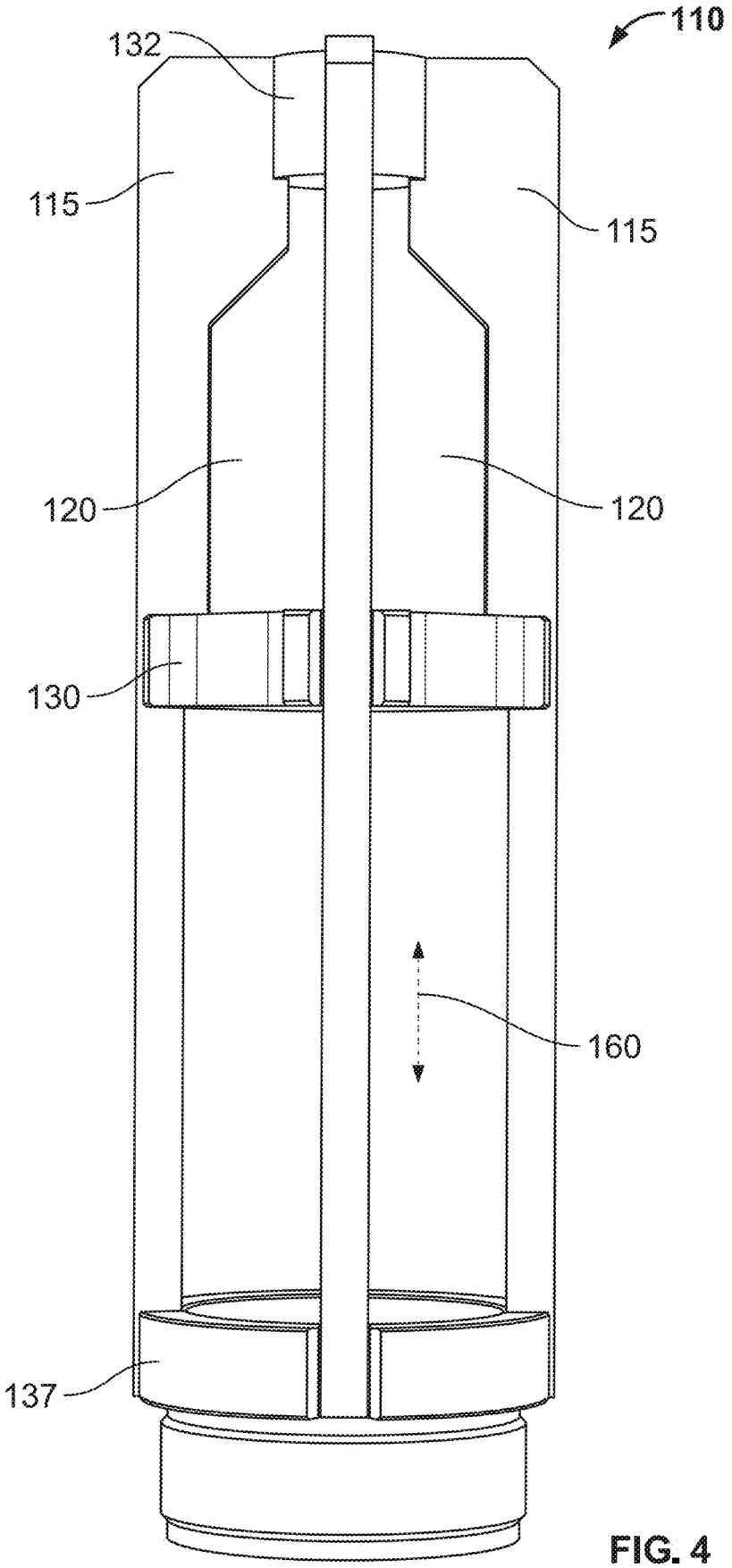
FIG. 4 depicts an illustrative side view of the sub-assembly 100, according to one or more embodiments described.

Considering the cage 110 in more detail, FIG. 3 depicts an illustrative top isometric view of the sub-assembly 100 and FIG. 4 depicts an illustrative side view. Referring to FIGS. 1-4, the cage 110 can further include one or more annular support rings or support spacers 130 (only one is shown) that are arranged perpendicular or substantially perpendicular to the longitudinal support arms 115. The one or more annular support spacers 130 are optional and can be added to provide lateral support to the longitudinal support arms 115. These optional support spacers 130 can be located anywhere along the longitudinal axis of the cage 110. In one particular embodiment, an annular support spacer 130 can be located approximately halfway between the first 118 end and second end 119 of the support arms 115. When present, each annular support spacer 130 can include one or more receivers or notches 132 formed in an annular body thereof. Each notch 132 can be sized and configured to receive at least a portion of an adjoining support arm 115. When configured in this manner, the annular support spacer 130 will have four notches 132, one notch 132 for each support arm 115, as depicted.

Still referring to FIGS. 1-4, the cylindrical cage 110 can include an upper or first support device 132 located at the upper or first end 118 of each longitudinal support arm 115. The first support device 132 can have an annular body and the first ends 118 of the longitudinal support arms 115 can be welded, attached or otherwise affixed to an outer surface of the annular body. The cylindrical cage 110 can also include a lower or second support device 137 located at the lower or second end 119 of each longitudinal support arm 115. The second support device 137 also can include an annular body having notch 138 formed therein for each support arm 115. Each notch 138 is configured to receive and support the second end 119 of an adjacent longitudinal support arm 115.

Figure 5:
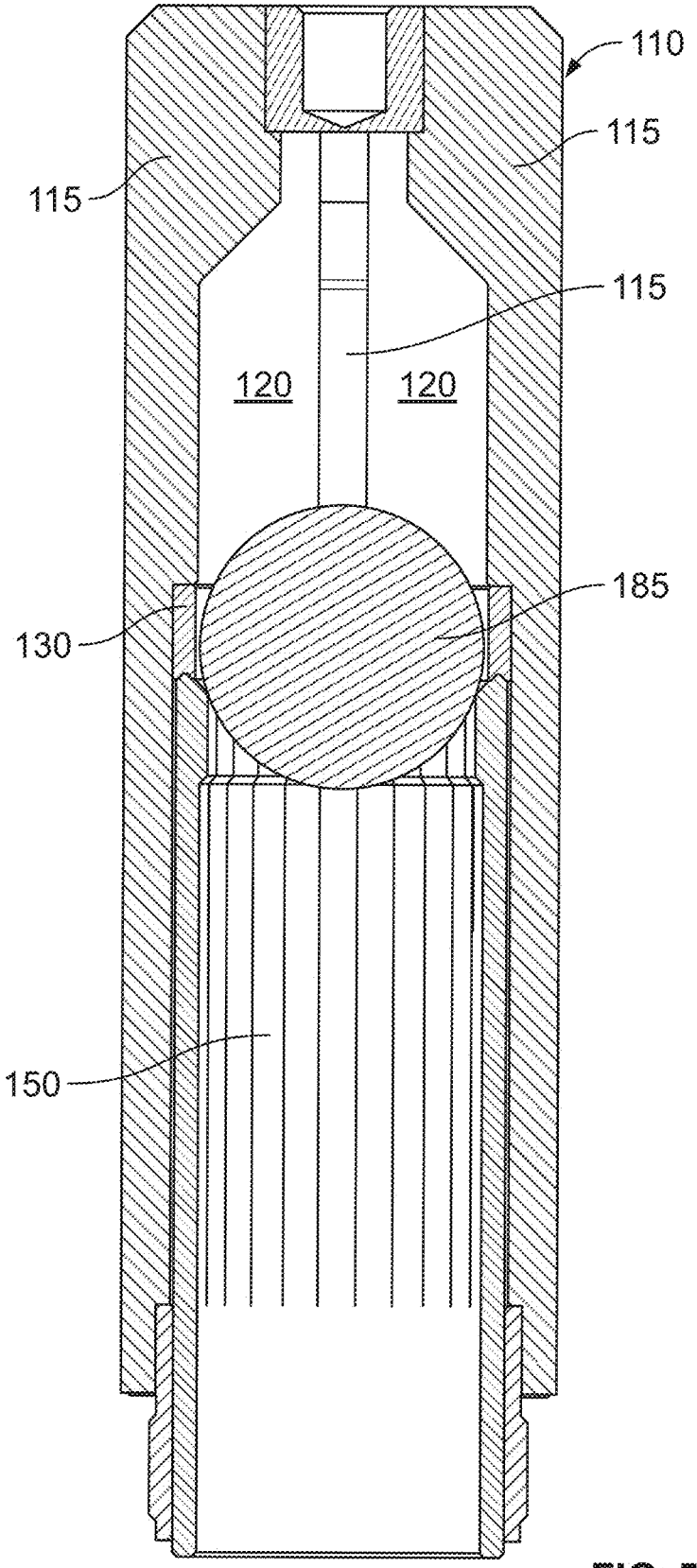
FIG. 5 depicts another illustrative vertical cross section of the sub-assembly 100, according to one or more embodiments described.
Figure 6:
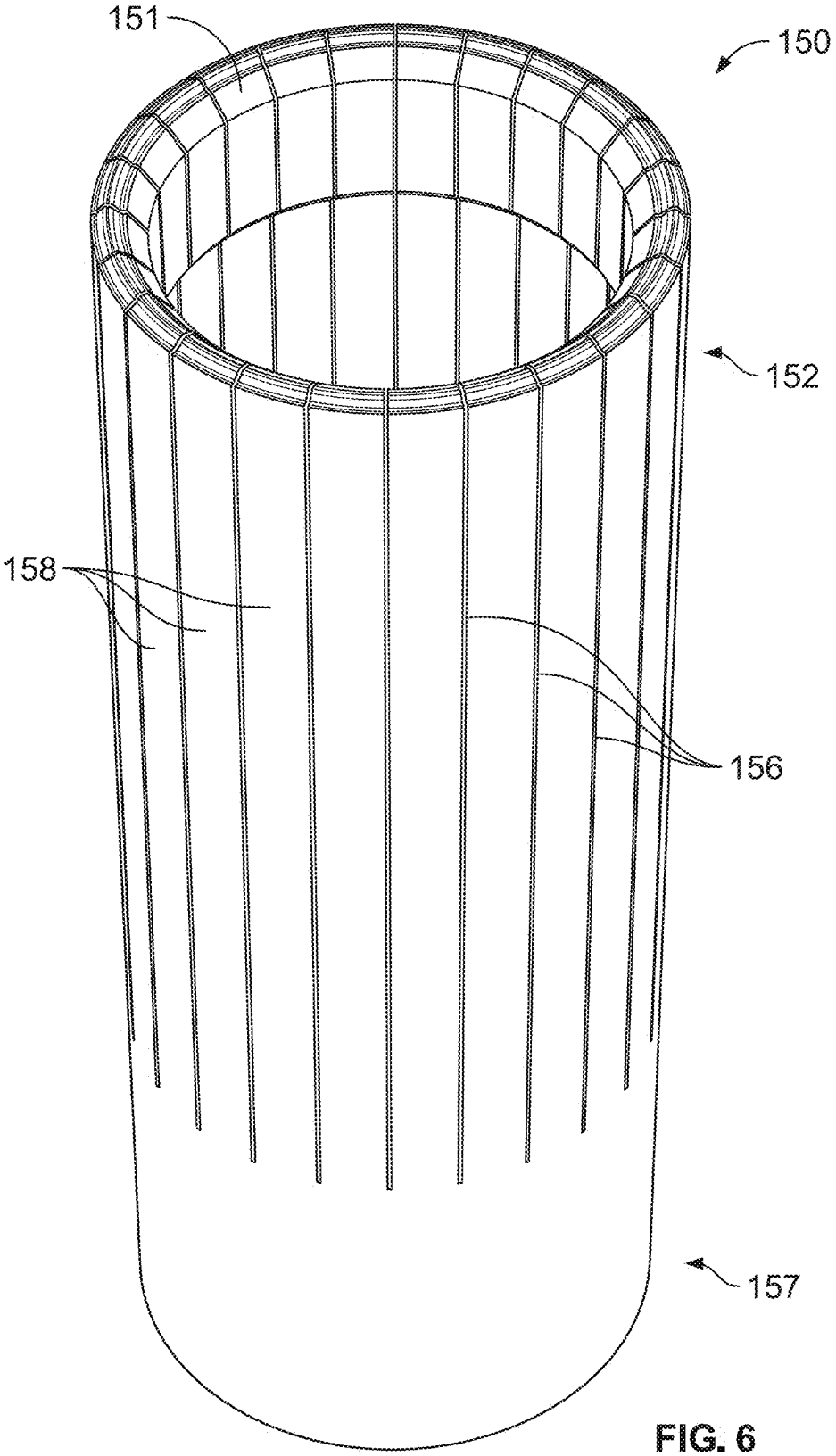
FIG. 6 depicts an illustrative top isometric view of the perforated insert 150, according to one or more embodiments described.
Figure 7:
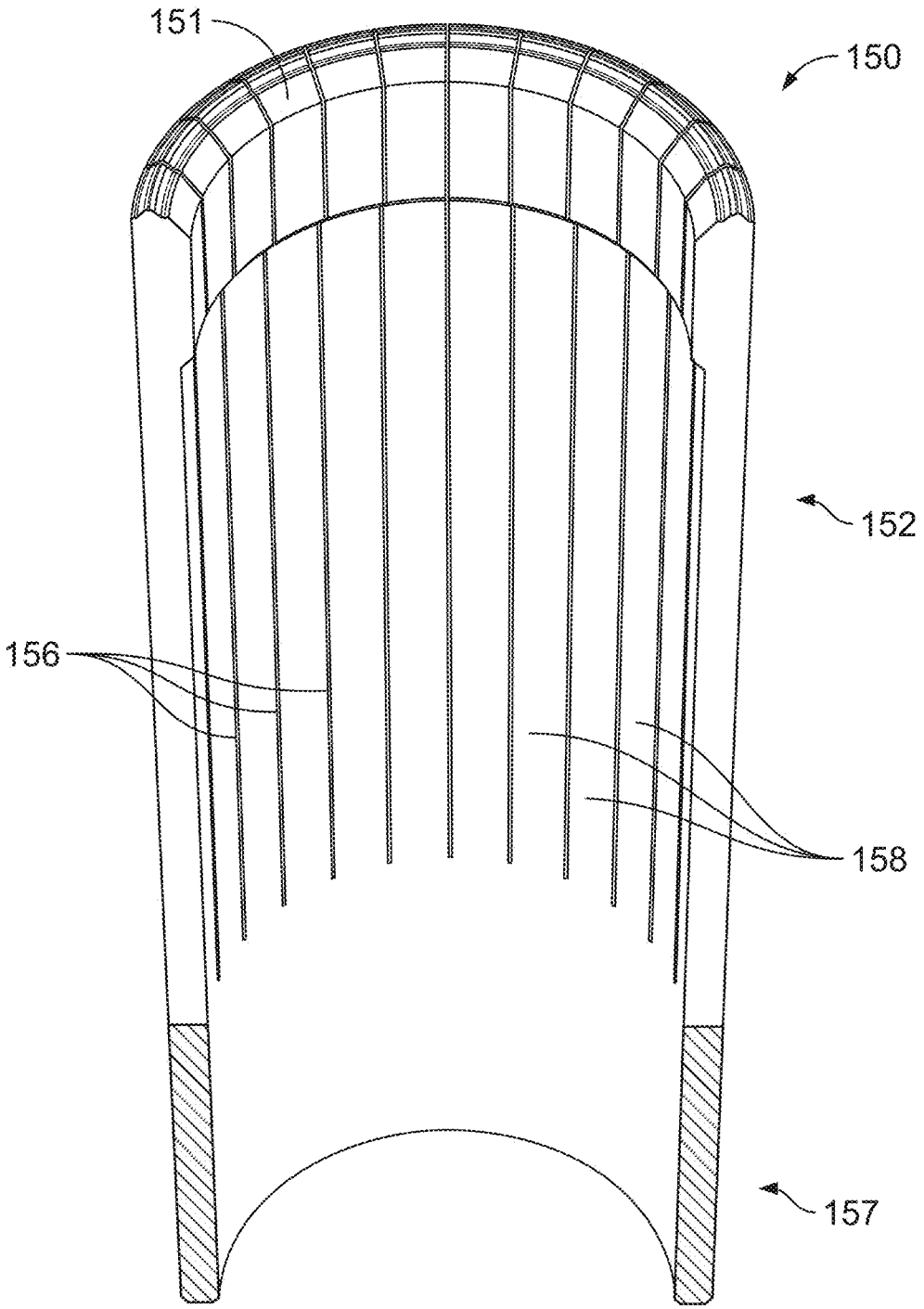
FIG. 7 depicts an illustrative cut-away view of the perforated insert 150 to better illustrate its internal surfaces, according to one or more embodiments described.

The perforated insert 150 is best described with reference to FIGS. 5-7. FIG. 5 depicts an illustrative vertical cross section of the sub-assembly 100 with the perforated insert 150 located at a lower portion thereof. FIG. 6 depicts an illustrative top isometric view of the perforated insert 150, and FIG. 7 depicts an illustrative cut-away view of the perforated insert 150 to better illustrate its internal surfaces, according to one or more embodiments. The perforated insert 150 can have two portions, a first portion that is solid and an adjoining second portion that is longitudinally slotted from the adjoining second portion to a first end of the perforated insert 150. The perforated insert 150 can be a single structural unit or unibody. Alternatively, the perforated insert 150 can be made from two or more separate units and attached together. The perforated insert 150 can include a plurality of openings, voids, slots, grooves or slits 156 that are formed throughout the sleeve 150. Such slots 156 can have any number of orientations. For example, each slot 156 can be horizontal, substantially horizontal, vertical, substantially vertical, or at any other angular orientation therebetween. The perforated insert 150 can have two continuous sections or portions, such as an upper or first portion 152 and a lower or second portion 157. The second portion 157 can be solid and the first portion 152 can contain the longitudinally formed slots 156. Said another way, the slots 156 can extend from the upper end of the sleeve 150 to the solid base 157.

The slots 156 of the perforated insert 150 can be lateral, longitudinal, angled, meshed or any combinations thereof. Preferably, the slots 156 are longitudinal, such as those depicted in FIGS. 6 and 7. The slots 156 form a plurality of spaced-apart fingers 158 that are configured to impede, block or otherwise catch solids that flow through the sub-assembly 100. The distances between each finger 158, i.e. the width of each slot 156, can be the same or can vary. Such distances, for example, can range from about 0.05 mm to about 1.6 mm, such as about 0.2 mm to about 1.3 mm, about 0.3 mm to about 1.0 mm, or about 0.2 mm to about 0.7 mm. The width of each slot 156 also can range from about 0.1, 0.2, 0.3, or 0.4 mm to about 0.5, 0.6, 0.7, 0.8, 0.9, or 1.2 mm. In other particular embodiments, the distance between any two adjacent fingers 158 can be at least, equal to, and/or between any two of 0.1, 0.2, 0.3, 0.4, 0.5, 0.6, 0.7, 0.8, 0.9, and 1.0 mm.

As best shown in FIGS. 6 and 7, the perforated insert 150 can have an upper or first end 152 that is chamfered, tapered or otherwise profiled to form a profiled surface or seat 151. In other words, the upper edge of each finger 158 can be profiled to define the seat 151. Because of the fingers 158 and slots 156 therebetween, the seat 151 is not a continuous surface. The profiled upper surface or seat 151 is configured to engage a restrictor or moveable member 185 that is contained within the cage 110, as depicted in FIGS. 1 and 5. In particular, the seat 151 is configured to engage and contact a moveable member 185 that is contained within the support arms 115 of the cage 110. The moveable member 185 can be any object capable of engaging or otherwise contacting the upper edge of each finger 158 (i.e. the seat 151) located at an upper end of the perforated insert 150. As such, the moveable member 185 does not completely seal off the inner diameter of the perforated insert 150. In a preferred embodiment, the profile of the seat 151 is complementary to a profile of the moveable member 185.

The moveable member 185 can be any suitable device or member capable of impeding fluid flow when seated. As mentioned above, a complete seal is not required or desired. For example, the moveable member 185 can be made of any suitable material for the downhole use, such cast iron, steel, stainless steel, brass, nickel, or ceramic. In certain embodiments, the moveable member 185 can be dissolvable.

In one preferred embodiment, the moveable member 185 is a ball, as illustrated in FIGS. 1 and 5. The moveable member 185 is not required or intended to completely seal off the upper end 152 of the sleeve 150. As such, the seated moveable member 185 restricts fluid flowing toward the inner diameter of the sleeve 150, but does not completely block fluid across the seat 151. In other embodiments, the moveable member 185 can be or can include a ball type valve that utilizes a spherical object (i.e. ball) that is sized and configured to engage a rounded seat. The moveable member 185 can also be or include a melon type, mushroom type, flapper, poppet, and the like, or any castellated configuration of the same, and the seat shape corresponding to the shape and configuration of the moveable member 185.

Figure 8:
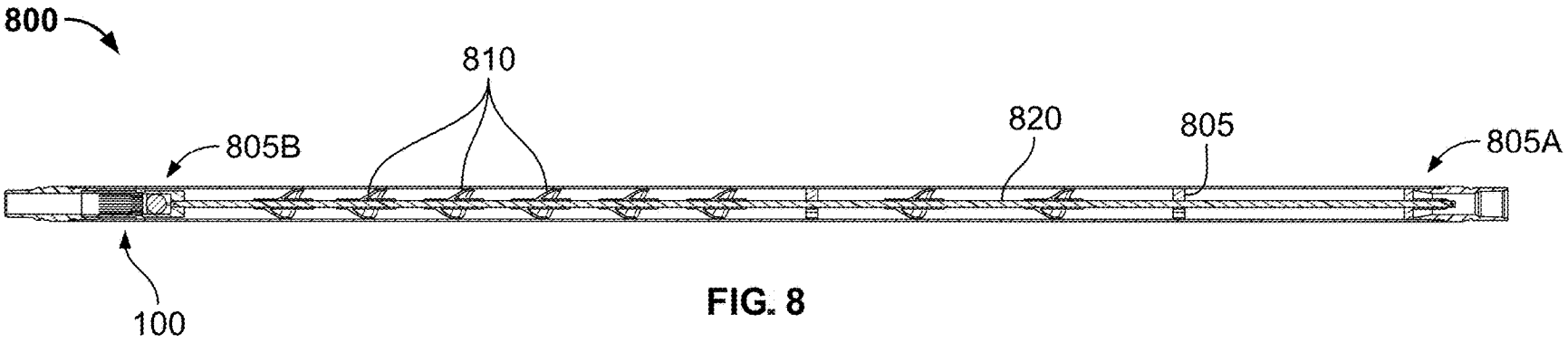
FIG. 8 depicts an illustrative schematic representation of a sand mediation tool 800 utilizing the sand catcher sub-assembly 100, according to one or more embodiments described.
Figure 9:
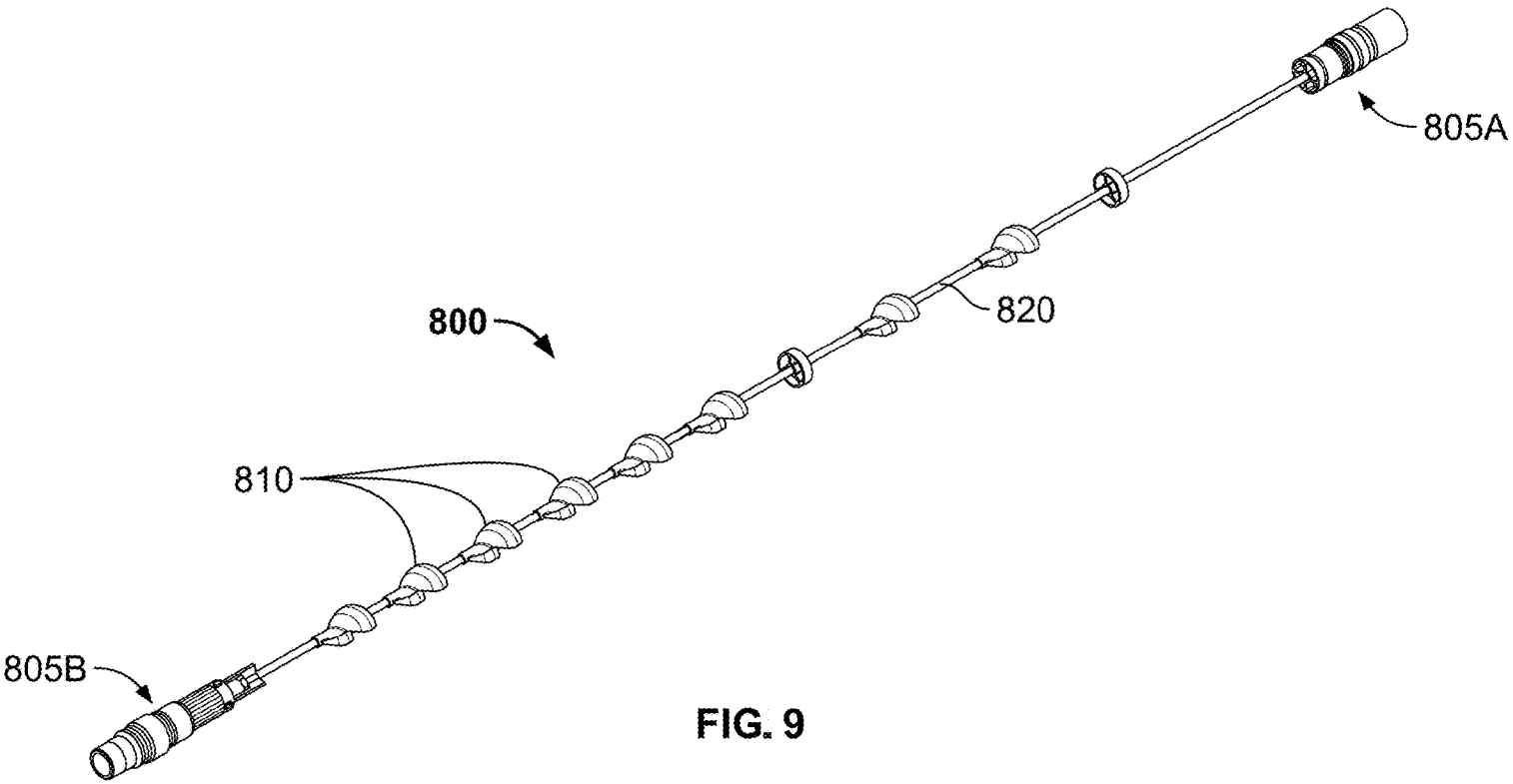
FIG. 9 depicts an illustrative schematic view showing the internals of the sand mediation tool 800 depicted in FIG. 8, according to one or more embodiments described.

FIG. 8 depicts an illustrative schematic representation of a sand mediation tool 800 utilizing the sand catcher sub-assembly 100, and FIG. 9 depicts an illustrative schematic view showing the internals of the sand mediation tool 800 depicted in FIG. 8, according to one or more embodiments described. In one or more embodiments, the tool 800 can have a tubular housing 805 that is connected at an upper or first end 805A thereof to a tubing string or casing disposed within a wellbore (not shown). A lower or second end 805B of the tubular housing 805 can be connected to the sand catcher sub-assembly 100 described herein. Although not shown, the lower end 119 of the sand catcher sub-assembly 100 can be connected, directly and/or indirectly, to a pump or tubular that is to be used downhole. The connection can be made above the surface and the assembled tool 800 can be run down hole on the tubing string (not shown), or the connection can be made in situ, within the wellbore.

The shaft 820 can be supported throughout the housing 805 using one or more spacers or supports 825 (two are shown in FIGS. 8-9) that are distributed throughout the housing 805, along the length of the shaft 820. The housing 805 can have any suitable length, which can be based on operational needs. For example, the housing can be between 6 ft, 8 ft, or 10 ft, and 15 ft, 20 ft, or 25 ft. The sizing of the housing can be maximised to the available diameter within the well while providing the space to pass a power cable externally to a pump below.

As further depicted in FIGS. 8 and 9, the sand mediation tool 800 can further include one or more collectors or collection supports 810 that can be integral with or separately disposed about a longitudinal rod or shaft 820 disposed within the housing 805. Each collection support 810 can be made from any suitable material or combination of materials for downhole use, such as rubber, plastic, cast iron, steel, metal alloys or any combination thereof. Any number of collection supports 810 can be used. When two or more collection supports 810 are used, the supports 810 can be located one on top of the other or can be spaced along the shaft 820. For example, the collection supports 810 can be spaced evenly, irregularly, contiguously, or at any frequency along the length of the shaft 820. The purpose of the collection support 810 is to provide a shelf or surface for passively holding free falling sand or other solid debris within the housing 805. Suitable collection supports 810 that can be used are shown and described in U.S. Pat. No. 11,939,991.

In a preferred embodiment, the collection supports 810 are petal shaped and have two or more movable or flexible arms or extensions. These movable or flexible extensions can be angled and configured to restrict flow in one direction and allow unrestricted flow in an opposite direction. For example, the petal-shaped supports 810 restrict flow towards the pump below the tool 800 and allow free fluid flow towards the wellbore surface, above the tool 800. The petal-shaped supports 810 can also be configured to form a wider opening when flow fluids away from the pump and can likewise be configured to form a narrower opening when flow flows toward the pump. This can be advantageous in allowing the petal-shaped supports 810 to restrict the movement of sand or other debris towards the pump while increasing the surface area available to collect falling sand or other debris within the tool 800. Additionally, the petal-shaped supports 810 can allow flow away from the pump to disturb and carry any sand or other debris collected around the petal-shaped supports 810 through the gaps in the movable or flexible extensions.

It should be appreciated that only a single flow path is contained within the tool 800 and through the sub-assembly 100. The single flow path 160 is contained within the housing 805 and extends from the upper end 805A to the lower end 805B of the tool 800 and continues past the sub-assembly 100, as shown in FIGS. 1-3. In operation, the sand mediation tool assembly 800 is set above an electrical submersible pump (i.e. "ESP") or any type of positive displacement pump ("PDP"). The tool 800 is designed and configured to prevent sand from settling on the pump outlet and preventing back pressure on the pump outlet. When the pump is turned off, the moveable member 185 falls due to gravity and seats again the upper end 152 of the perforated insert 150. The moveable member 185 prevents solids from settling on top of the sleeve 150 and diverts the fluid flow to the outside of the slotted fingers 158, still within the single flow path 160, where the solids are filtered and/or screened and otherwise blocked from entering the annulus of the sleeve 150. Accordingly, the settling or falling solids are re-directed to the outer periphery of the flow path 160. This allows for a few solids, if any, to collect on top of the moveable member 185, allowing the moveable member 185 to more easily move in a vertical direction, lifting off the seat 151, when pump operations resume. As the pump moves fluid vertically through the flow path 160, the solids within the outer periphery of the flow path 160 are siphoned or sucked into the flow, thereby clearing the solids from the sub-assembly 100.

As mentioned above, the moveable member 185 does not completely restrict flow to and from the pump. Accordingly, the moveable member 185 can have any number of imperfections. The moveable member 185 can also be a castellated valve that provides protrusions and/or gaps to allow fluid flow therethrough, even while the moveable member 185 is in a closed configuration. This constant fluid communication helps, and in some cases, prevents sand or other debris from forming a densely packed plug at or around the outer surface of the moveable member 185 that may be difficult for the pump to clear, upon restart.

In the stopped position, the moveable member 185 allows fluid flow to and from the pump, while restricting sand or other debris from passing to the pump while sand 802 and other debris are able to settle on the upper collection supports 102 before spilling over and settling on the lower supports 102. This is advantageous when pumping operations are resumed because the additional fluid volume between the furthest collection supports 102 and the pump helps drive the collected sand.

It should be appreciated that the sub-assembly 100 and tool 800 do not have a bypass or alternative flow path. The tool 800, containing the sub-assembly 100, provides only a single flow path 160 therethrough.

The present invention further includes any one or more of the following specific numbered embodiments 1 through 25:

Embodiment 1: An apparatus for catching sand above a submersible pump, comprising a cage having at least two longitudinal support arms, at least one window defined between any two of the support arms, and an annular spacer configured to support the at least two longitudinal support arms; a perforated insert that is at least partially disposed within the cage, wherein a first end of the perforated insert has a seat formed therein for engaging a moveable member that is contained within the cage; and a flow path, in fluid communication with the cage and the perforated insert, wherein passage of solids, fluids or both through the flow path is at least partially restricted in a first flow direction when the moveable member contacts the seat of the perforated insert and passage is not restricted in a second flow direction that is opposite of the first flow direction when the moveable member does not contact the seat.

Embodiment 2: An apparatus for catching sand above a submersible pump, comprising: a cage having at least two longitudinal support arms, at least one window defined between any two of the support arms, and an annular spacer configured to support the at least two longitudinal support arms; a perforated insert that is at least partially disposed within the cage, wherein a first end of the perforated insert has a seat formed therein for engaging a moveable member that is contained within the longitudinal support arms of the cage; and a flow path, in fluid communication with the cage and perforated insert, wherein passage of fluids through the flow path is at least partially restricted and passage of solids through the flow path is blocked in a first flow direction when the moveable member contacts the seat of the perforated insert and passage is not restricted in a second flow direction that is opposite of the first flow direction when the moveable member does not contact the seat.

Embodiment 3: The apparatus of Embodiments 1 or 2, wherein the cylindrical cage further comprises a first support device located at a first end of the longitudinal support arms, wherein the first support device has an annular body and the first ends of the longitudinal support arms are attached to an outer surface of the annular body.

Embodiment 4: The apparatus of any Embodiment 1 to 3, wherein the cylindrical cage further comprises a second support device located at a second end of the longitudinal support arms, wherein the second support device comprises an annular body having a notch formed therein for each support arm, the notch configured to receive and support the second end of each longitudinal support arm.

Embodiment 5: The apparatus of any Embodiment 1 to 4, wherein the notches formed in the annular body are equally spaced about a circumference of the second support device.

Embodiment 6: The apparatus of any Embodiment 1 to 5, wherein the annular spacer is located between the first and second ends of the support arms and comprises an annular body having a notch formed therein for each support arm, wherein the notch receives and supports the support arm.

Embodiment 7: The apparatus of any Embodiment 1 to 6, wherein the annual spacer is located approximately halfway between the first and second ends of the support arms.

Embodiment 8: The apparatus of any Embodiment 1 to 7, wherein the perforated insert has two portions, a first portion that is solid and an adjoining second portion that is longitudinally slotted from the adjoining second portion to a first end of the perforated insert.

Embodiment 9: The apparatus of any Embodiment 1 to 8, wherein the seat is formed within the slotted first end of the perforated insert.

Embodiment 10: The apparatus of any Embodiment 1 to 9, wherein the longitudinal slots of the perforated insert form a plurality of fingers configured to catch any solids that move through the flow path in the first flow direction.

Embodiment 11: An apparatus for catching sand above a submersible pump, comprising: a cage disposed within the housing, the cage having at least two longitudinal support arms, at least one window defined between any two of the support arms, and an annular spacer configured to support the at least two longitudinal support arms; a moveable member that is contained within the cage; a perforated insert that is at least partially disposed within the cage, wherein a first end of the perforated insert has a seat formed thereon for engaging moveable member, wherein passage of solids, fluids or both across the perforated insert is at least partially restricted in a first flow direction when the moveable member contacts the seat of the perforated insert and not restricted in a second flow direction that is opposite of the first flow direction when the moveable member does not contact the seat.

Embodiment 12: The apparatus of Embodiment 11, wherein the cylindrical cage further comprises a first support device located at a first end of the longitudinal support arms, wherein the first support device has an annular body and the first ends of the longitudinal support arms are attached to an outer surface of the annular body.

Embodiment: 13: The apparatus of Embodiments 11 or 12, wherein the cylindrical cage further comprises a second support device located at a second end of the longitudinal support arms, wherein the second support device comprises an annular body having a notch formed therein for each support arm, the notch configured to receive and support the second end of each longitudinal support arm.

Embodiment 14: The apparatus of Embodiments 13, wherein the notches formed in the annular body are equally spaced about a circumference of the second support device.

Embodiment 15: The apparatus of any Embodiments 11 to 14, further comprising an annular spacer located between the first and second ends of the support arms, the annular spacer comprising an annular body having a notch formed therein for each support arm, wherein the notch receives and supports the support arm.

Embodiment 16: The apparatus of Embodiments 15, wherein the annual spacer is located approximately halfway between the first and second ends of the support arms.

Embodiment 17: The apparatus of any Embodiments 11 to 16, wherein the perforated insert has two portions, a first portion that is solid and an adjoining second portion that is longitudinally slotted from the adjoining second portion to a first end of the perforated insert.

Embodiment 18: The apparatus of Embodiments 17, wherein the seat is formed within the slotted first end of the perforated insert.

Embodiment 19: The apparatus of Embodiments 17, wherein the longitudinal slots of the perforated insert form a plurality of fingers configured to catch any solids that move through the flow path in the first flow direction.

Embodiment 20: An apparatus for catching sand above a submersible pump, comprising: a cage having at least two longitudinal support arms, at least one window defined between any two of the support arms, and an annular spacer configured to support the at least two longitudinal support arms; and a perforated insert that is at least partially disposed within the cage, wherein a first end of the perforated insert has a seat formed therein for engaging a moveable member that is contained within the longitudinal support arms of the cage, wherein passage of solids, fluids or both across the perforated insert is at least partially restricted in a first flow direction when the moveable member contacts the seat of the perforated insert and not restricted in a second flow direction that is opposite of the first flow direction when the moveable member does not contact the seat.

Embodiment 21: A method for operating a hydrocarbon well, comprising: providing a production tubular, a downhole pump in the production tubular, and a sand catcher sub-assembly coupled to the production tubular above the downhole pump, the sand catcher sub-assembly comprising: a cage having at least two longitudinal support arms and at least one window defined between any two of the support arms; a moveable member that is contained within the cage; a perforated insert that is at least partially disposed within the cage below the moveable member, wherein a first end of the perforated insert has a seat formed therein for engaging the moveable member; operating the downhole pump to cause fluid to flow in a first flow direction through the production tubular away from the pump, wherein the pumped fluid lifts the moveable member away from contact with the seat and is not restricted through the sand catcher sub-assembly in the first flow direction; stopping the pump to cause fluid to flow in a second flow direction through the production tubular toward the pump, wherein passage of the fluid through the cage is at least partially restricted in the second flow direction when the moveable member contacts the seat of the perforated insert, and solid particles within the fluid are collected about the outside of the perforated insert; and restarting the pump to cause fluid to flow in the first flow direction through the production tubular away from the pump, which lifts at least a portion of the collected solid particles away from the sand catcher sub-assembly and carries away the lifted solid particles within the fluid.

Embodiment 22: The method of Embodiment 21, wherein the solid particles within the fluid fall by gravity within the production tubular when the pump is stopped.

Embodiment 23: The method of Embodiments 21 or 22, wherein the perforated insert filters the falling solid particles from the fluid as the fluid passes through the insert toward the pump.

Embodiment 24: The method of any Embodiments 21 to 23, wherein the perforated insert has two portions, a first portion that is solid and an adjoining second portion that is longitudinally slotted from the adjoining second portion to a first end of the perforated insert.

Embodiment 25: The method of any Embodiments 21 to 24, wherein the longitudinal slots of the perforated insert form a plurality of fingers configured to catch any solids that move through the flow path in the first flow direction.

Various terms have been defined above. To the extent a term used in a claim is not defined above, it should be given the broadest definition persons in the pertinent art have given that term as reflected in at least one printed publication or issued patent. All numerical values in this disclosure may be exact or approximate values unless otherwise specifically stated. Accordingly, various embodiments of the disclosure may deviate from the numbers, values, and ranges disclosed herein without departing from the intended scope.

Furthermore, all patents, test procedures, and other documents cited in this application can be fully incorporated by reference to the extent such disclosure is not inconsistent with this application and for all jurisdictions in which such incorporation is permitted.

While the foregoing is directed to more preferred embodiments of the present invention, other and further embodiments of the invention may be devised without departing from the basic scope thereof, and the scope thereof is determined by the claims that follow.

What is claimed is:

1. An apparatus for catching sand above a submersible pump, comprising:

a cage having at least two longitudinal support arms, at least one window defined between any two of the support arms, and an annular spacer configured to support the at least two longitudinal support arms;

a moveable member that is contained within the cage;

a perforated insert that is at least partially disposed within the cage, wherein a first end of the perforated insert has a seat formed thereon for engaging the moveable member, wherein passage of solids, fluids or both across the perforated insert is at least partially restricted in a first flow direction when the moveable member contacts the seat of the perforated insert and not restricted in a second flow direction that is opposite of the first flow direction when the moveable member does not contact the seat.

2. The apparatus of claim 1, wherein the cage further comprises a first support device located at a first end of the longitudinal support arms, wherein the first support device has an annular body and the first ends of the longitudinal support arms are attached to an outer surface of the annular body.

3. The apparatus of claim 2, wherein the cage further comprises a second support device located at a second end of the longitudinal support arms, wherein the second support device comprises an annular body having a notch formed therein for each support arm, the notch configured to receive and support the second end of each longitudinal support arm.

4. The apparatus of claim 3, wherein the notches formed in the annular body are equally spaced about a circumference of the second support device.

5. The apparatus of claim 1, further comprising an annular spacer located between the first and second ends of the support arms, the annular spacer comprising an annular body having a notch formed therein for each support arm, wherein the notch receives and supports the support arm.

6. The apparatus of claim 5, wherein the annual spacer is located approximately halfway between the first and second ends of the support arms.

7. The apparatus of claim 1, wherein the perforated insert has two portions, a first portion that is solid and an adjoining second portion that is longitudinally slotted from the adjoining second portion to a first end of the perforated insert.

8. The apparatus of claim 7, wherein the seat is formed within the slotted first end of the perforated insert.

9. The apparatus of claim 7, wherein the longitudinal slots of the perforated insert form a plurality of fingers configured to catch any solids that move through the flow path in the first flow direction.

10. An apparatus for catching sand above a submersible pump, comprising:

a cage having at least two longitudinal support arms, at least one window defined between any two of the support arms, and an annular spacer configured to support the at least two longitudinal support arms; and a perforated insert that is at least partially disposed within the cage, wherein a first end of the perforated insert has a seat formed therein for engaging a moveable member that is contained within the longitudinal support arms of the cage, wherein passage of solids, fluids or both across the perforated insert is at least partially restricted in a first flow direction when the moveable member contacts the seat of the perforated insert and not restricted in a second flow direction that is opposite of the first flow direction when the moveable member does not contact the seat.

11. A method for operating a hydrocarbon well, comprising:

providing a production tubular, a downhole pump in the production tubular, and a sand catcher sub-assembly coupled to the production tubular above the downhole pump, the sand catcher sub-assembly comprising: a cage having at least two longitudinal support arms and at least one window defined between any two of the support arms; a moveable member that is contained within the cage; a perforated insert that is at least partially disposed within the cage below the moveable member, wherein a first end of the perforated insert has a seat formed therein for engaging the moveable member;

operating the downhole pump to cause fluid to flow in a first flow direction through the production tubular away from the pump, wherein the pumped fluid lifts the moveable member away from contact with the seat and is not restricted through the sand catcher sub-assembly in the first flow direction;

stopping the pump to cause fluid to flow in a second flow direction through the production tubular toward the pump, wherein passage of the fluid through the cage is at least partially restricted in the second flow direction when the moveable member contacts the seat of the perforated insert, and solid particles within the fluid are collected about the outside of the perforated insert; and restarting the pump to cause fluid to flow in the first flow direction through the production tubular away from the pump, which lifts at least a portion of the collected solid particles away from the sand catcher sub-assembly and carries away the lifted solid particles within the fluid.

12. The method of claim 11, wherein the solid particles within the fluid fall by gravity within the production tubular when the pump is stopped.

13. The method of claim 12, wherein the perforated insert filters the falling solid particles from the fluid as the fluid passes through the insert toward the pump.

14. The method of claim 11, wherein the perforated insert has two portions, a first portion that is solid and an adjoining second portion that is longitudinally slotted from the adjoining second portion to a first end of the perforated insert.

15. The method of claim 14, wherein the longitudinal slots of the perforated insert form a plurality of fingers configured to catch any solids that move through the flow path in the first flow direction.

* * * * *